US011663880B2

(12) United States Patent
Guibord

(10) Patent No.: US 11,663,880 B2
(45) Date of Patent: May 30, 2023

(54) CARD GAME METHOD AND TABLE LAYOUT THEREFOR

(71) Applicant: Eugene Norman Guibord, Oak Creek, WI (US)

(72) Inventor: Eugene Norman Guibord, Oak Creek, WI (US)

( * ) Notice: Subject to any disclaimer, the term of this patent is extended or adjusted under 35 U.S.C. 154(b) by 162 days.

(21) Appl. No.: 17/301,183

(22) Filed: Mar. 29, 2021

(65) Prior Publication Data

US 2021/0312752 A1 Oct. 7, 2021

Related U.S. Application Data

(60) Provisional application No. 63/004,168, filed on Apr. 2, 2020.

(51) Int. Cl.
*G07F 17/32* (2006.01)

(52) U.S. Cl.
CPC ..... *G07F 17/322* (2013.01); *G07F 17/3272* (2013.01); *G07F 17/3293* (2013.01)

(58) Field of Classification Search
USPC ..... 463/25
See application file for complete search history.

(56) References Cited

U.S. PATENT DOCUMENTS 5,288,081 A 2/1994 Breeding
5,678,821 A 10/1997 Hedman
5,895,048 A 4/1999 Smith, Jr.
5,979,897 A 11/1999 Grossman
7,066,465 B2 6/2006 Daines
7,108,264 B2 9/2006 Byrne et al.
7,175,522 B2 2/2007 Hartl
7,419,162 B2 9/2008 Lancaster et al.
7,434,809 B2 10/2008 Silverman
7,621,535 B2 11/2009 Spivey
8,177,616 B2 5/2012 Nicely
8,413,989 B2 4/2013 Sparago
2007/0228653 A1 10/2007 Lambert et al.
2007/0241501 A1 10/2007 Kling et al.
2009/0118006 A1* 5/2009 Kelly ..... A63F 13/2145 463/31
2010/0113140 A1* 5/2010 Kelly ..... G07F 17/32 463/30
2012/0108337 A1* 5/2012 Kelly ..... G07F 17/3211 463/37

(Continued)

*Primary Examiner* — Pierre E Elisca
(74) *Attorney, Agent, or Firm* — Dunlap Bennett & Ludwig, PLLC; Anna L. Kinney

(57) ABSTRACT

A card game tabletop layout includes a curved tabletop with a dealer play area and at least one player area. The player area has an initial betting indicator, a bonus betting indicator, a draw betting indicator, and an odds and payout list. A card game method using the curved tabletop includes providing a playing card deck having 52 cards; distributing three cards to the dealer area and to the player area; determining whether to obtain an additional card to approach and not exceed a score of 27; exposing the dealer's cards and the player's cards; and determining whether the dealer's or the player's cards achieved a score closest to 27. The game method includes determining whether the three cards match a criterion listed on the odds and payout list. This simple card game is quickly understood by players who then feel comfortable playing without confusion.

14 Claims, 4 Drawing Sheets

(56) References Cited

U.S. PATENT DOCUMENTS

| | | | | |
|---|---|---|---|---|
| 2012/0112412 | A1 | 5/2012 | Esposito | |
| 2014/0094298 | A1* | 4/2014 | Lyons | G07F 17/3204 463/31 |

* cited by examiner

CARD GAME METHOD AND TABLE LAYOUT THEREFOR

CROSS-REFERENCE TO RELATED APPLICATION

This application claims the benefit of priority of U.S. provisional application No. 63/004,168, filed Apr. 2, 2020, the contents of which are herein incorporated by reference.

BACKGROUND OF THE INVENTION

The present invention relates to a method of playing a card game and, more particularly, to a tabletop layout therefor.

The gaming industry is a very lucrative industry with an ultra-competitive environment between casino owners. The industry has a constant problem keeping potential players enthused and entertained enough to continue playing their games. When games become stagnant or less appealing, the businesses that provide them lose revenue. Providing a steady flow of new games is vital to maintaining and improving customer growth. Like a revolving door, casino managers continue introducing new games and promotions instrumental in generating interest to lure players from competitors. The casino industry is always seeking new games to keep players entertained. However, new games may be too complicated for players to follow.

As can be seen, there is a need for a new, simple, and entertaining game.

SUMMARY OF THE INVENTION

The present invention provides a simple card game that players may quickly understand and feel comfortable playing without confusion. The inventive game has elements that statistically appeal to players and game rules that are easily explained to a novice player in minimal time. The game may be played on a table with a physical deck of cards or on an electronic device such as a slot machine, computer, or mobile device. The game may be positioned in an area where other games of the same nature are placed to draw the most traffic and probability of play.

In one aspect of the present invention, a card game tabletop layout is provided, comprising a curved tabletop with a dealer play area and at least one player area, wherein the at least one player area comprises an initial betting indicator, a bonus betting indicator, a draw betting indicator, and an odds and payout list.

In another aspect of the present invention, a card game method is provided, comprising providing a curved tabletop with a dealer play area and at least one player area; providing a playing card deck having 52 cards; distributing three cards to the dealer area and to the at least one player area; determining whether to obtain an additional card to approach and not exceed a score of 27; exposing the dealer's cards and the at least one player's cards; and determining whether the dealer's or the at least one player's cards achieved a score closest to 27; wherein the at least one player area includes an initial betting indicator, a bonus betting indicator, a draw betting indicator, and an odds and payout list.

In another aspect of the present invention, a card game method is provided, comprising: providing a curved tabletop with a dealer play area and at least one player area; providing a playing card deck having 52 cards; distributing three cards to the at least one player area; exposing the three cards; and determining whether the three cards match a criterion listed on an odds and payout list; wherein the at least one player area includes a required betting indicator, a bonus betting indicator, a draw betting indicator, and the odds and payout list.

These and other features, aspects and advantages of the present invention will become better understood with reference to the following drawings, description, and claims.

DETAILED DESCRIPTION OF THE INVENTION

Figure 1:
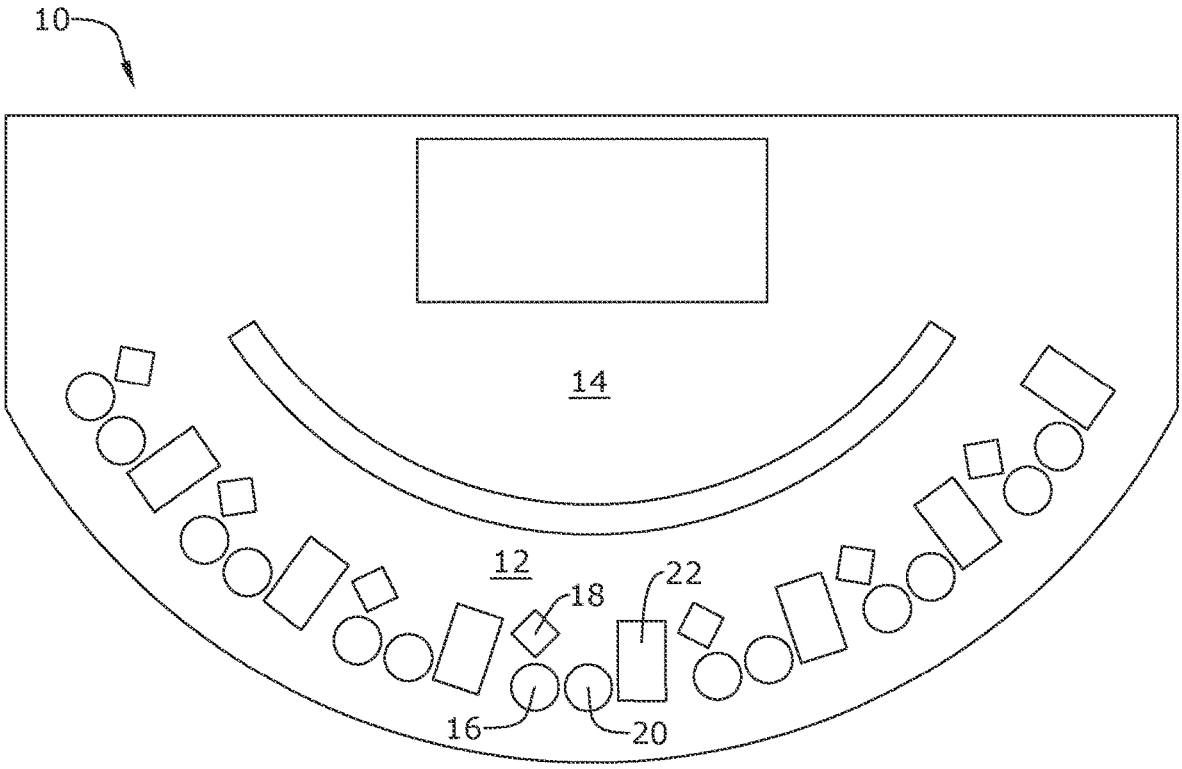
FIG. 1 is a schematic view of a tabletop with a betting diagram for a card game according to an embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a card game played on a tabletop with a diagram including, for each player, a betting indicator for "Bonus 7", a betting indicator for "Ante", a betting indicator for "Draw", and a display of odds corresponding to a player's initial hand of 3 cards. Each player may add cards to most closely approach a score of 27 without exceeding 27.

The present invention employs a standard 52 card deck, betting chips/markers, a diagram of betting circles, and a dealer to distribute the cards. Numeral cards may be counted as their respective numbers, face cards may be counted as ten, and Ace cards may be counted as 1 or 11.

A diagram of betting circles may be displayed on a tabletop. Players may wager on betting circles depicted on the diagram layout as follows: Ante (27) and/or Bonus (7). Each player may place a wager on betting spots depicted on the layout. In some embodiments, the tabletop may have an indicator expressly disclosing the "27" goal.

Generally, the cards are shuffled prior to play. Cards may be shuffled by hand, although a mechanical shuffling device is preferred, programmed to disburse three cards at a time as needed.

An individual may qualify as a player by following predetermined guidelines. Each player may identify a monetary wager amount. The dealer may issue 3 cards sequentially to each player and may keep three cards to form the dealer's hand.

A player's first 3 cards may qualify for a bonus hand. Players may choose to play only for a bonus hand which is not compared to the dealer's hand. If the player's first three cards qualify for a bonus hand as depicted on the layout, the player may be paid a predetermined bonus. If no player's first 3 cards qualify, the Bonus 7 wager may be forfeit. For example, the layout may indicate that if the initial hand adds to a value of 27, the payout odds are 3:2 and/or that if the initial hand includes the 10, 9, and 8 cards of a single suit, the payout odds are 300:1. Other winning card combinations may include three "9" cards; Ace, Ace, "5"; straight flush; triples of a number other than 7 or 9; three "7" cards; a straight; a flush; and any other three cards of a single number.

Players may review their cards to determine the hand's proximity to a score of 27. The players may declare that they need another card and pay the dealer for an additional card. The dealer is generally the last person to act on his hand.

Once every player has confirmed that they will not request additional cards, the dealer exposes his 3-card hand and if necessary, draws an additional card. Once dealer's hand is announced, the players hands are exposed and compared to the dealer's hand. If a player's hand total is closest to 27 without exceeding 27, the Ante and Draw (if played) is paid. Once all hands have been decided, paid, and/or taken, the round is over, and all cards are retrieved from the players. Cards may be collected in order from the dealer's right to left for game security.

In an embodiment referred to herein as "Three Card 7-27", a player competes directly with the dealer. The player receives three cards from the dealer with the objective to reach a numeric total closer to 27 than the dealer. The player may pay for one additional card if they wish (i.e., a draw wager).

Figure 2:
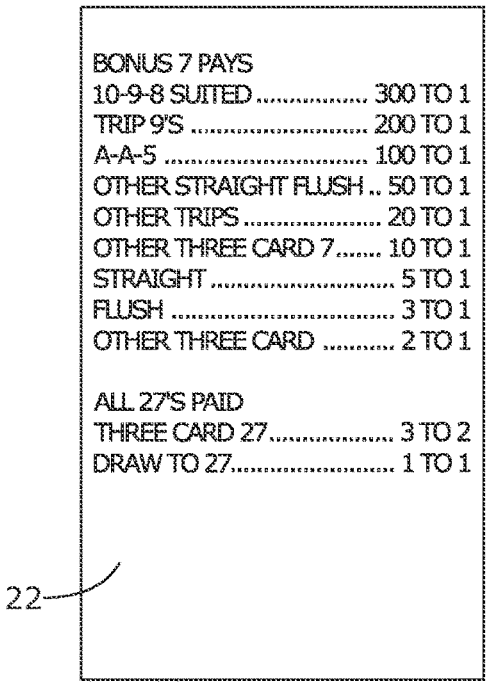
FIG. 2 is a top plan view of an odds and payouts list therefor.
Figure 3:
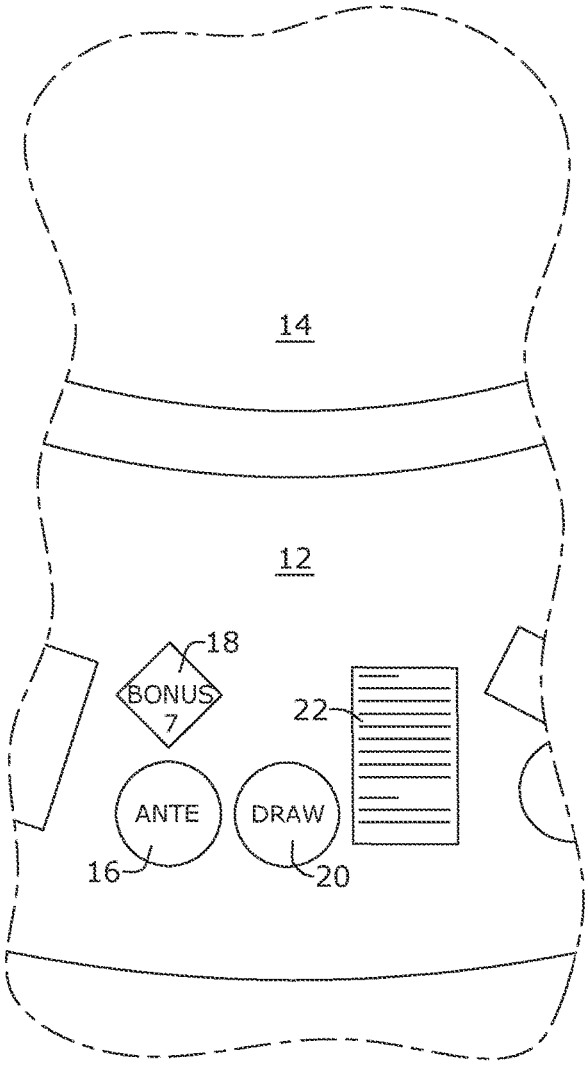
FIG. 3 is a detail view of the tabletop of FIG. 1, showing the layout for a single player.
Figure 4:
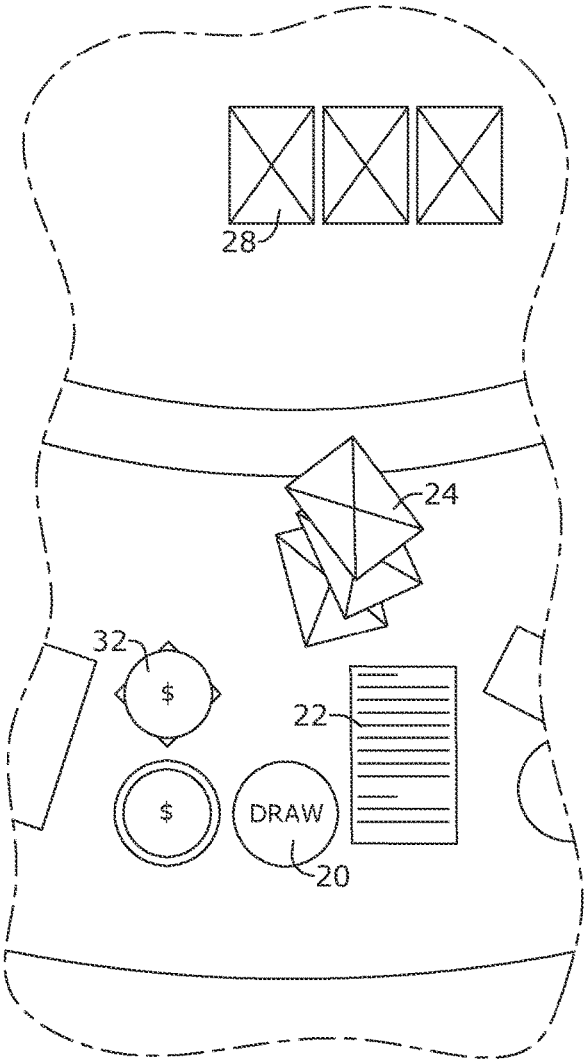
FIG. 4 is a schematic view illustrating an initial distribution of cards therefor.
Figure 5:
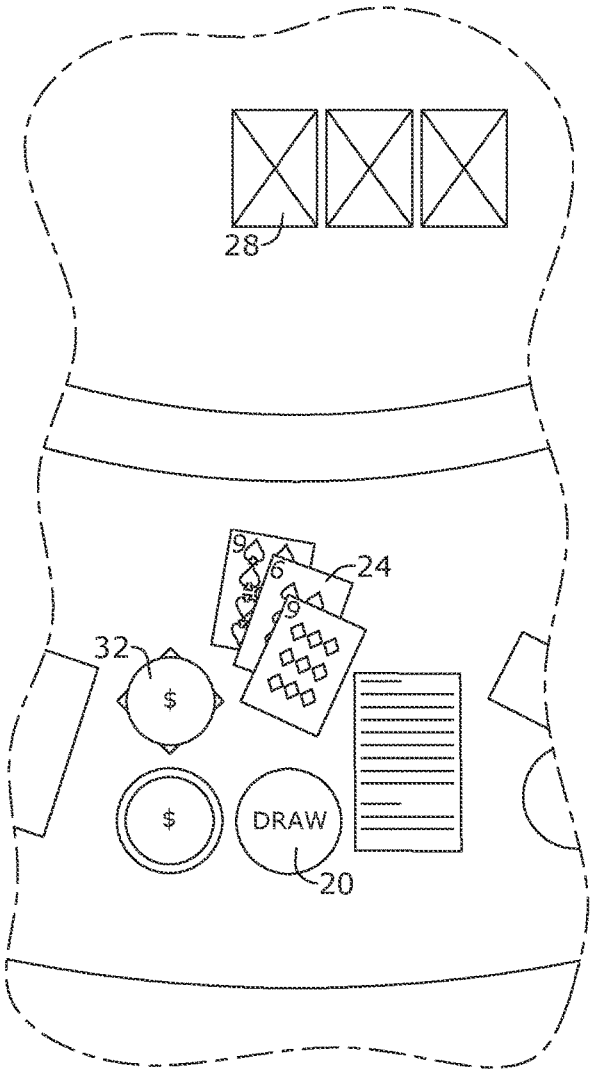
FIG. 5 is a schematic view illustrating a step of a player evaluating the initial cards.
Figure 6:
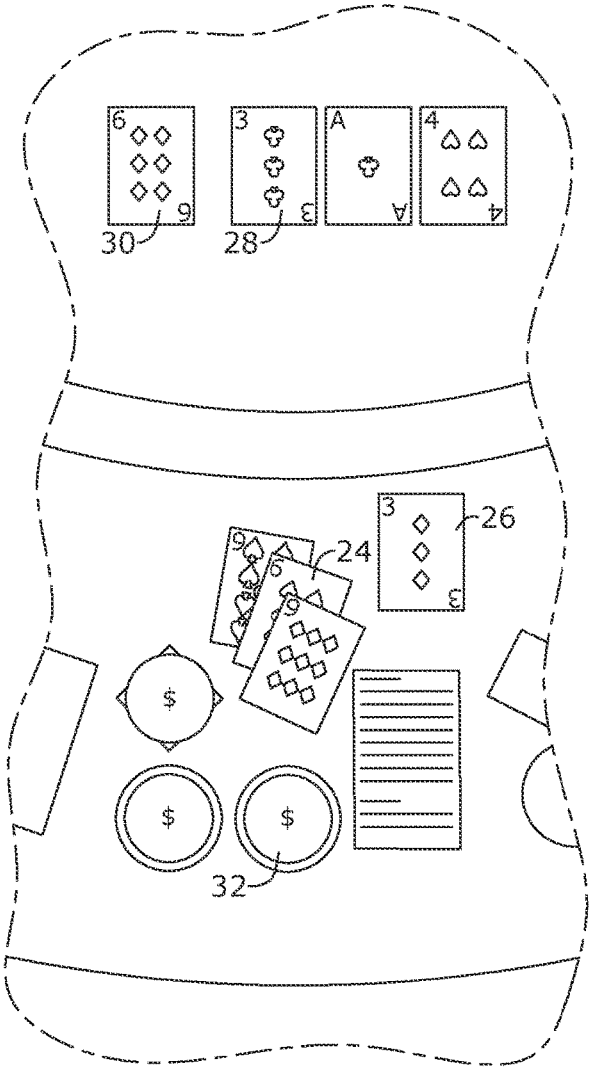
FIG. 6 is a schematic view illustrating a step of exposing all hands to determine a winner.
Figure 7:
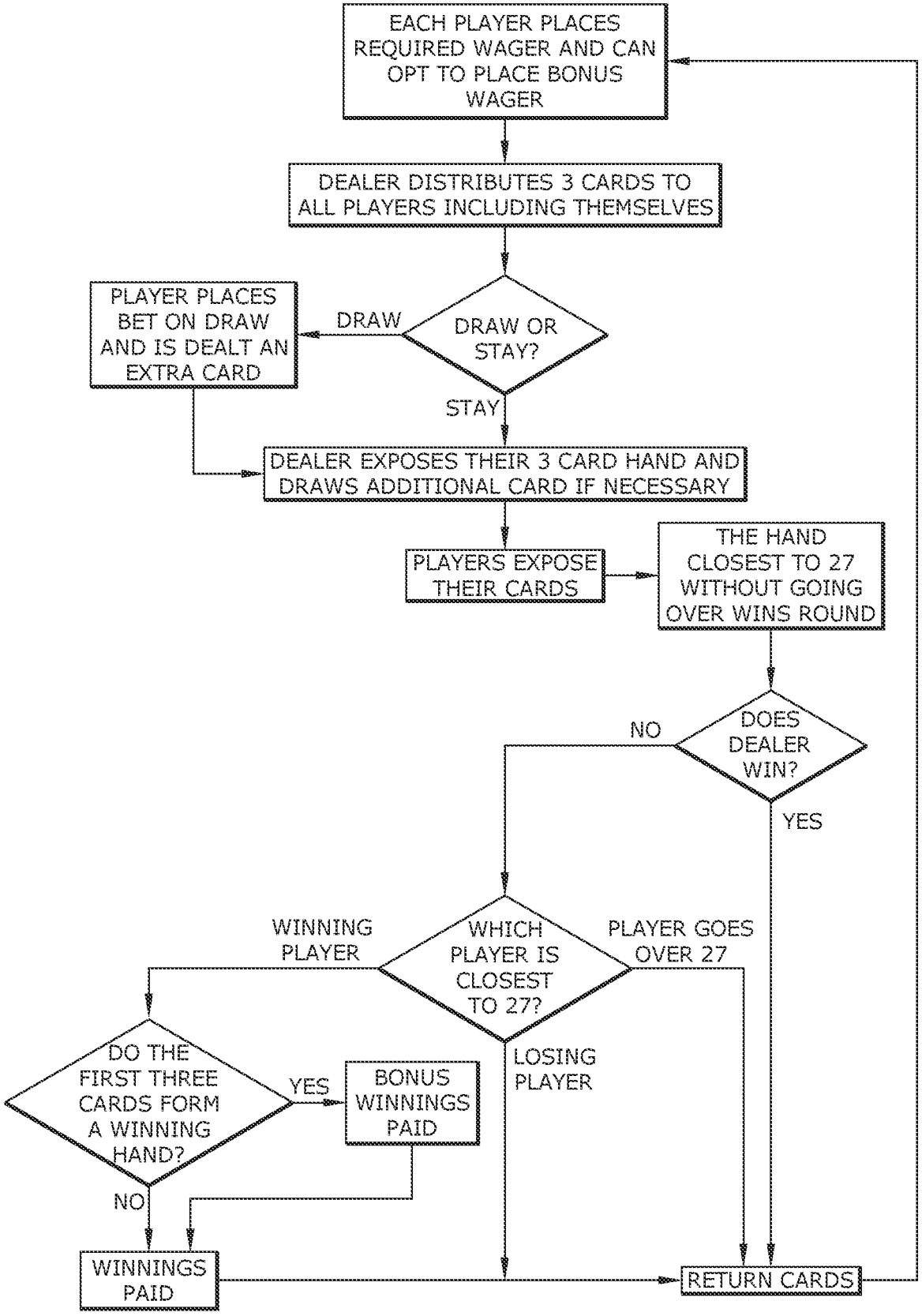
FIG. 7 flow chart of a gameplay process according to an embodiment of the present invention.

Referring to Figures, FIG. 1 shows the layout of a table 10 showing the layout of the player's play areas 12 and dealer's play area 14. Each player's area 12 includes a required betting area 16, an optional bonus betting area 18, and draw card betting area 20, shown in more detail in FIG. 3, and a bonus hands odds and payout list 22, shown in more detail in FIG. 2. FIG. 4 illustrates the table 10 layout at the beginning of gameplay, including the player's first dealt cards 24, the player's initial wager 32, and the dealer's first dealt cards 28. As shown in FIG. 5, the player evaluates the initial hand of cards 24 and decides whether to place a draw wager. Once the player places a draw wager 32, the dealer issues the player's draw card 26, and may also select a dealer's draw card 30, as illustrated in FIG. 6. In the example shown in FIG. 6, the player has achieved an exact score of 27 and therefore wins. FIG. 7 illustrates the method of gameplay in which players place wagers, the dealer distributes cards, each player decides whether to place a draw wager or stay, and all cards are exposed. Whoever achieves a score closest to 27 without going over wins and, if a player, is paid winnings. Although FIG. 7 shows a bonus play after determining a winner, a player may alternatively choose to only place a bonus wager and not to participate in the remainder of the game (not shown).

It should be understood, of course, that the foregoing relates to exemplary embodiments of the invention and that modifications may be made without departing from the spirit and scope of the invention as set forth in the following claims.

What is claimed is:

1. A card game tabletop layout, comprising a curved tabletop with a dealer play area and at least one player area, wherein the at least one player area comprises an initial betting indicator, a bonus betting indicator, a draw betting indicator, and an odds and payout list; and wherein the initial betting indicator and the draw betting indicator are laterally juxtaposed circles, the bonus betting indicator is a quadrangle vertically juxtaposed with the required betting indicator, and the odds and payout list is positioned adjacent to the draw betting indicator opposite the required betting indicator.

2. The card game tabletop layout of claim 1, wherein the bonus betting indicator is labeled Bonus 7, the initial betting indicator is labeled Ante, and the draw betting indicator is labeled Draw.

3. A card game method, comprising:

a) providing a curved tabletop with a dealer play area and at least one player area;

b) providing a playing card deck having 52 cards;

c) distributing three cards to the dealer area and to the at least one player area;

d) determining whether to obtain an additional card to approach and not exceed a score of 27;

e) exposing the dealer's cards and the at least one player's cards; and f) determining whether the dealer's or the at least one player's cards achieved a score closest to 27;

wherein the at least one player area includes an initial betting indicator, a bonus betting indicator, a draw betting indicator, and an odds and payout list.

4. The card game method of claim 3, wherein numeral cards have a value consistent with their face value, face cards have a value of 10, and Ace cards have a value of 1 or 11.

5. The card game method of claim 3, further comprising placing a wager on the initial betting indicator prior to distributing cards.

6. The card game method of claim 3, further comprising placing a wager on the draw betting indicator and distributing an additional card to the at least one player area.

7. The card game method of claim 3, further comprising distributing an additional card to the dealer play area.

8. The card game method of claim 3, wherein a plurality of players are each positioned at a respective at least one player area and when the plurality of players and the dealer stay, the player of the plurality of players having the highest score not exceeding 27 is awarded winnings.

9. The card game method of claim 3, further comprising determining whether the three cards distributed to the at least one player area match a criterion listed on the odds and payout list.

10. The card game method of claim 3, wherein the tabletop and cards are displayed on an electronic device.

11. A card game method, comprising:

a) providing a curved tabletop with a dealer play area and at least one player area;

b) providing a playing card deck having 52 cards;

c) distributing three cards to the at least one player area;

d) exposing the three cards; and e) determining whether the three cards match a criterion listed on an odds and payout list;

wherein the at least one player area includes a required betting indicator, a bonus betting indicator, a draw betting indicator, and the odds and payout list.

12. The card game method of claim 11, further comprising placing a wager on the bonus betting indicator prior to distributing cards.

13. The card game method of claim 11, wherein the criterion listed on the odds and payout list are selected from the group consisting of: a total value of 27; 10, 9, and 8 cards of a single suit; Ace, Ace, 5; straight flush; triples; a straight; a flush; and any combination thereof.

14. The card game method of claim 11, wherein numeral cards have a value consistent with their face value, face cards have a value of 10, and Ace cards have a value of 1 or 11.

* * * * *